United States Patent [19]

Georgii

[11] 4,287,919

[45] Sep. 8, 1981

[54] PROCESS IN THE MANUFACTURE OF SPACE FRAMEWORKS, AND A MACHINE FOR THE MANUFACTURE THEREOF

[75] Inventor: Hans C. Georgii, Stockholm, Sweden

[73] Assignee: AB Hydro Betong, Sweden

[21] Appl. No.: 40,382

[22] Filed: May 18, 1979

[30] Foreign Application Priority Data

May 23, 1978 [SE] Sweden ..... 7805891

[51] Int. Cl.[3] ..... B21F 27/10

[52] U.S. Cl. ..... 140/112; 219/56

[58] Field of Search ..... 140/92.1, 112, 9; 219/56

[56] References Cited

U.S. PATENT DOCUMENTS 2,137,257 11/1938 White ..... 140/112

3,706,331 12/1972 Pennington ..... 140/112

*Primary Examiner*—Lowell A. Larson

*Attorney, Agent, or Firm*—Karl W. Flocks

[57] ABSTRACT

A space framework comprises two multi-wire systems of spirally-wound wires, the wires which, in the one system, are wound in the one direction, and, in the other system, are wound in the other direction, being interconnected at points where they intersect. In the manufacturing process, the wires in both systems are wound simultaneously in opposite directions during simultaneous advancement. In this instance, the wires are stretched and shaped about a forming device. The wires are then interconnected at those points where, in the winding operation, they intersect at the outer contour of the space framework.

A machine for manufacturing a space framework consists of magazines for supplying the wires in both systems, for winding purposes, a templating and welding device for the wound wires, and an advancement means for the space framework produced at the templating and welding device.

6 Claims, 4 Drawing Figures

1
2
3
4
5
6
7
8
9
10
11
12
13
14

PROCESS IN THE MANUFACTURE OF SPACE FRAMEWORKS, AND A MACHINE FOR THE MANUFACTURE THEREOF

The present invention relates to a process in the manufacture of a space framework which, in section, has straight sides and which comprises two multi-wire systems of spirally-wound wires, the wires which, in the one system are wound in one direction and in the other system are wound in the other direction, being interconnected at their points of intersection. According to the invention, the wires in both systems are wound simultaneously in opposite directions during the simultaneous advancement of the finished portion of the space framework at a rate corresponding to the pitch of the spiral windings, the wires, during the winding operation, being stretched and formed about a crown or other forming tool, and the wires being interconnected at those points where the windings intersect at the outer contour of the space framework.

The invention also relates to a machine for the manufacture of the space framework. According to the invention, the machine consists of a magazine for the delivery of the wires in the two systems, for the purposes of winding, a templating and welding device for the wound wires, and a supply means for the space framework produced at the templating and welding device.

The present invention has now made it possible to manufacture the space framework in an economical, rapid and effective manner. Thus, the invention may be considered as constituting an essential further development of the ideas which form the basis of Swedish Pat. Nos. (application No. 13976/70), 367,856 and 388,893.

The invention will be described in greater detail below in association with the accompanying drawing which schematically illustrates the process and the machine according to the invention.

Figures 1, 2, 3, 4:
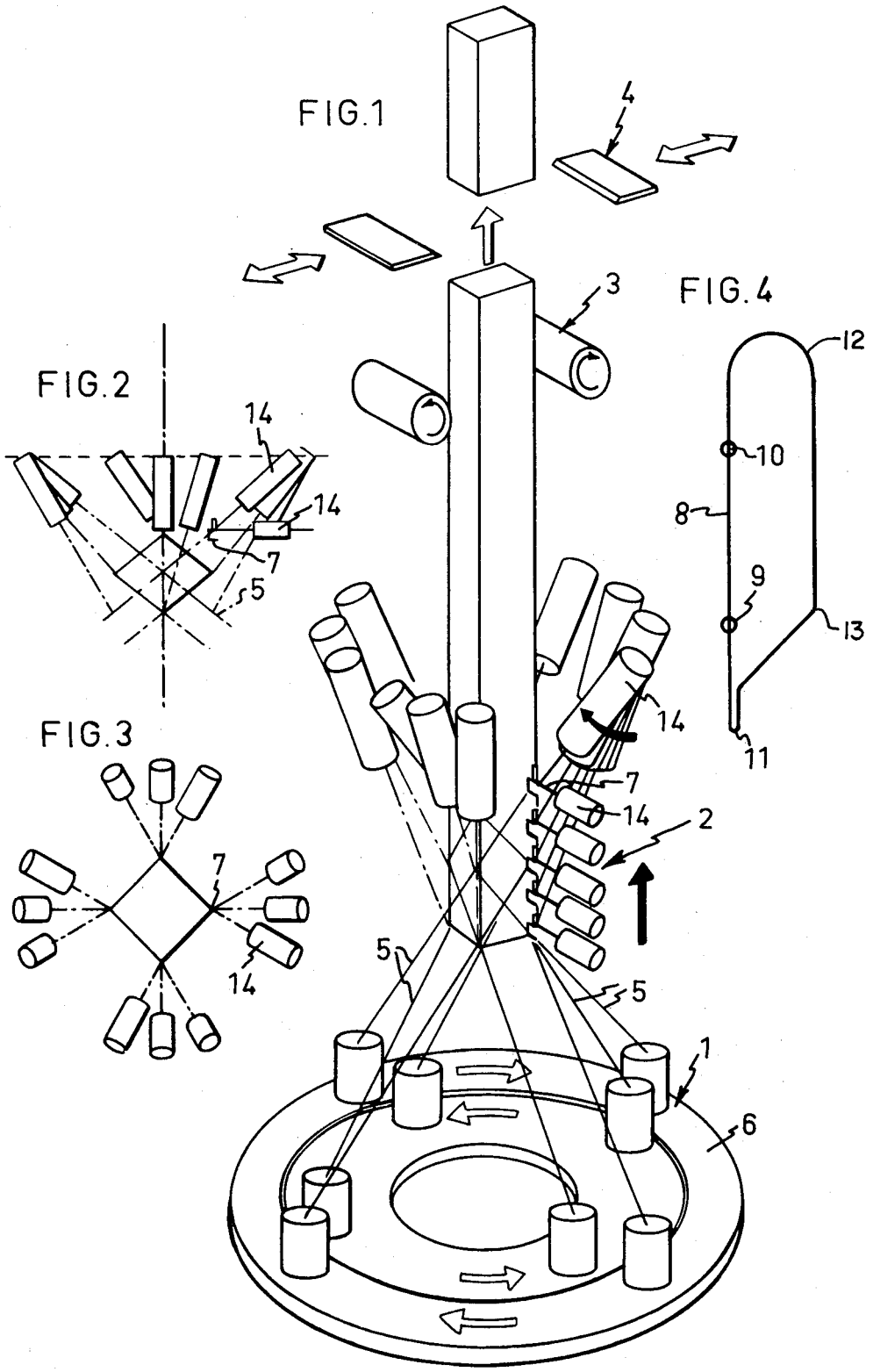
FIG. 1 is a perspective view of the machine.
FIG. 2 is a side elevation of the templating and welding device.
FIG. 3 shows the same in section.
FIG. 4 illustrates the movement cycle of the welding electrodes.

The main parts of the machine consist, according to the drawing, of the wire magazine 1, the templating and welding device 2, the supply apparatus 3 and the clipper 4. Normally, the space framework should be provided in the corners of the section with longitudinal rods which preferably consist of angle irons or the like disposed on the inside or outside. The angle irons may be produced by shaping of metal strip supplied from rollers or a similar magazine, the angle irons being welded at the corners before the clipper 4.

The magazine 1 may either consist of separate wire magazines for each spiral wire 5, or a compact magazine with all wires in a spiral cluster wound up on a drum which follows with the rotation of traction discs 6 at a speed adapted to the formation of the finished space framework.

The templating and welding device 2 consists of a number of welding electrodes 7 designed as holders which are disposed to carry out a movement cycle at least substantially in accordance with FIG. 4. Thus, the movement cycle embraces the travel 8 where the electrode follows the outer contour of the space framework, seen in the direction of advancement. More precisely, the welding operation is intended to take place when the electrode 7 moves between the points 9 and 10.

The elctrode 7 moves in to the outer contour of the space framework at point 11 and catches the two counter-running wires 5 at that point where the deflection, the deformation, is to take place. Thereafter, the electrode 7 follows the point of intersection at the same speed with which the finished space framework is advanced. Hence, in this instance, the welding is effected between the points 9 and 10. Thereafter, the electrode 7 releases its grip, departs from the wires 5 and withdraws outside the section to the point 12 whence it rapidly returns to the point 13 and thence once again in to the section to the point 11 where a new pair of intersecting wires is waiting.

The machine is, at least at those portions which correspond to all corners of the space framework, provided with a number of welding electrodes 7. The number of welding electrodes 7 in each corner is determined by the number of wires 5 in the spiral clusters, and by the pitch of these wires 5 along the sides of the section. The drawing shows three electrodes 7 stationed at each corner in the section. For each electrode 7, there is the requisite number of hydraulic devices 14 for managing the movement cycle of the electrode 7 without disturbance between the electrodes 7.

As is apparent from the drawing, the wires 5 are wound, in both systems, simultaneously in opposite directions under simultaneous advancement of the finished portion of the space framework at a rate corresponding to the pitch of the spiral windings. Thus, the wires 5 will, like right and left-hand threads, follow the contours of the space framework. The angle of pitch is dependent upon the ratio between the winding speed and the advancement speed. This can, thus, be varied between different space frameworks and within one and the same space framework.

The wires 5 are caught by the welding electrodes 7 designed as holders, at those points which correspond to the corners of the space framework. Bending of the wires 5 between the sides of the space framework will, thus, take place at the electrodes 7. When the electrodes 7 heat up the wires 5 in the points of intersection, the bending operation will be facilitated. Because of this heating, the pull on the wires 5 between the traction discs and the point of deformation can be restricted. Obviously, the shaping of the wire 5 takes place simultaneously with the welding phase.

The advancement and clipping take place in a conventional manner. The rollers 3 and clipper 4 shown on the drawing should, thus, rather be considered as symbolic.

By means of the hydraulic device 14, at least continuous section changes can take place. The section may be caused to reduce or increase, respectively. In the production of masts and girders, this is an obvious advantage.

The machine according to the illustrated embodiment lacks a crown for shaping the space framework. This machine could, however, be combined with a crown. In such an instance, the design of the edges of the crown may be effected such that the welding electrodes 7 may enter a distance into the edge proper of the crown. This results in very great possibilities for varying the size of the section.

The invention is not restricted to that described above and shown on the drawing, variations being possible within the spirit and scope of the accompanying claims.

What I claim and desire to secure by Letters Patent is:

1. A process in the manufacture of a space framework such as in section has straight sides and comprises two multi-wire systems of spirally wound wires (5), the wires (5) of which, in one system are wound in one direction and in the other system are wound in the other direction, being interconnected at points where they intersect, wherein said wires (5) in both systems are wound simultaneously in opposite directions during the simultaneous advancement of the finished portion of the space framework at a rate corresponding to the pitch of the spiral windings, including steps of catching pairs of counter-running wires (5) at those points where they, during the winding operation, intersect at the outer contour of the space framework by means of welding electrodes in the form of holders (7) to follow the points of intersection of the counter-running wires (5) caught thereby at the speed at which the framework is advanced, thereby bending and leading the wires (5) to the final contour of the space framework, and welding the wires (5) at the same time such wires (5) are being bent and led to the final contour of the space framework to effect interconnection of the wires (5) at the points of intersection.

2. The process as recited in claim 1, wherein said holders (7) heat said wires (5) at their points of intersection, such that the bending operation is facilitated.

3. The process as recited in claim 2, wherein the mutual spacing of said holders (7) is altered, whereby the size of the cross-section of the space framework is changed.

4. A machine for manufacturing a space framework such as in section has straight sides and comprises two multi-wire systems of spirally wound wires, said wires which, in one system are wound in the one direction, and in the other system are wound in the other direction, being interconnected at points where they intersect, wherein said machine comprises magazines (1) for the delivery of wires (5) in both systems for winding purposes, a templating and welding device (2) for the wound wires (5) and an advancement means (3) for the space framework produced at the templating and welding device (2), wherein said templating and welding device (2) consists of a number of welding electrodes (7) in the form of holders disposed to execute a movement cycle comprising a travel (8) in which the electrodes (7) follow the outer contour of the space framework, seen in the advancement direction, wherein in operation of said machine each of said holders (7) catches a pair of counter-running wires (5) where they intersect at the outer contour of the space framework, bends and leads the counter-running wires (5) to the final contour of the space framework while simultaneously welding such counter-running wires (5) to effect interconnection thereof at their points of intersection.

5. The machine as recited in claim 4, wherein it is provided, at least at those portions which correspond to all corners of the space framework, with a number of welding electrodes (7).

6. The machine as recited in claim 4 or 5, wherein each welding electrode (7) is provided with one or more hydraulic devices (14) or the like which are operative to impart to said electrode (7) its movement cycle.

* * * * *